United States Patent [19]

Schuler et al.

[11] Patent Number: 4,548,056

[45] Date of Patent: Oct. 22, 1985

[54] STAMPED KNITTING TOOL FOR KNITTING MACHINES

[75] Inventors: Bernhard Schuler, Sonnenbühl; Ferdinand Schuller; Werner Wohlgemuth, both of Albstadt, all of Fed. Rep. of Germany

[73] Assignee: Theodor Groz & Söhne & Ernst Beckert, Albstadt-Ebingen, Fed. Rep. of Germany

[21] Appl. No.: 647,261

[22] PCT Filed: Aug. 14, 1982

[86] PCT No.: PCT/DE82/00166

§ 371 Date: Apr. 11, 1983

§ 102(e) Date: Apr. 11, 1983

[87] PCT Pub. No.: WO83/00706

PCT Pub. Date: Mar. 3, 1983

Related U.S. Application Data

[63] Continuation of Ser. No. 488,544, Apr. 11, 1983.

[30] Foreign Application Priority Data

Aug. 22, 1981 [DE] Fed. Rep. of Germany ..... 3133266

[51] Int. Cl.[4] ..... D04B 35/06

[52] U.S. Cl. ..... 66/121; 66/116

[58] Field of Search ..... 66/121, 122, 120, 119, 66/116

[56] References Cited

U.S. PATENT DOCUMENTS

| | | | |
|---|---|---|---|
| 2,685,787 | 1/1952 | Noe | 66/121 |
| 2,854,836 | 10/1958 | Morris | 66/121 |
| 4,178,781 | 12/1979 | Virgilio et al. | 66/121 |
| 4,210,003 | 7/1980 | Sqrillo et al. | 66/120 |

OTHER PUBLICATIONS

Wignall, H., "Knitting Times", Kinetics and Economics of Weft Knitting–Part 6, Jun. 4, 1973, pp. 78–84.

*Primary Examiner*—Henry S. Jaudon
*Assistant Examiner*—Mary A. Ellis
*Attorney, Agent, or Firm*—Frishauf, Holtz, Goodman & Woodward

[57] ABSTRACT

A stamped knitting tool for knitting machines, for instance a latch needle, compound needle, bearded needle, plush hook or the like, has a hook formed on a stem with an intermediate neck, the hook being entirely made of a profiled material of substantially rectangular cross section, up to the end of the hook or the beginning of a hook point embodied there.

In order to assure that the hook is capable of withstanding the great stresses occurring during the knitting process without the danger of premature breakage or bending open of the hook or other damage while keeping the hook at an appropriately small size, the hook (5), beginning at a maximum value (3) of the cross-sectional dimensions close to the neck (4), formed with steadily decreasing tapering cross-sectional dimensions from the vicinity of the neck (4) toward the end of the hook or the region of the beginning of the hook point (9).

14 Claims, 8 Drawing Figures

STAMPED KNITTING TOOL FOR KNITTING MACHINES

Figure 1:
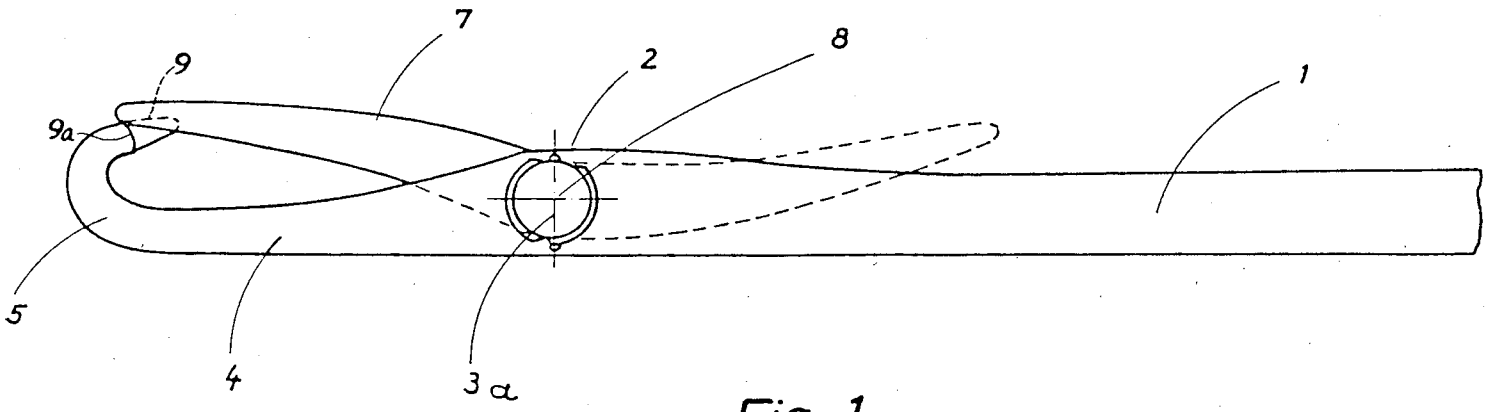

This application is a continuation of application Ser. No. 488,544 filed Apr. 11, 1983.

The invention relates to a stamped knitting tool for knitting machines and more particularly for knitting machine needle e.g. a latch needle, compound needle, plush hook or the like, which has a hook formed on a shank with an intermediate neck section. Up to the end of the hook or the beginning of a hook point, the hook is entirely made of a shaped material having a substantially rectangular cross section.

BACKGROUND

The knitting tools of the type under discussion are latch needles, compound needles and bearded needles, as well as plush hooks such as are used for producing plush goods, and the like.

In knitting tools of this kind, the hook in the great majority of tools has a circular cross-sectional form. The growing increase in the operating speed of knitting machines equipped with knitting tools of this kind results in ever-increasing stresses on the knitting tools in the vicinity of the hook. In order to increase the strength of the hook, the attempt has already been made to form it with a rectangular, triangular or other cross-sectional shape, such as is known for example from U.S. Pat. Nos. 2,854,836, 4,178,781 and 4,210,003. Although the section modulus of the highly stressed hook could be increased by these changes in cross section, such hooks have not become established in practice because as a consequence of the large cross section, which remains uniform over the entire hook, undesirably large dimensions on the part of the entire hook necessarily resulted. Needles with such relatively large hooks cannot be used in producing very fine grades of knitted goods, for instance, because the size of the loop or stitch, is also determined by the size of the hook, and because during loop formation a maximum amount of free space should be available for the thread at the side of the hook.

THE INVENTION

It is an object of the invention to provide a stamped knitting tool for knitting machines, the hook of which is capable of withstanding the great stresses occurring during the knitting process without thedanger of premature breakage or bending open or other damage to the hook, and which at the same time has a hook of appropriately small size.

Briefly the hook has varying cross-sectional dimensions which, beginning with a maximum value for these dimensions in the vicinity of the neck, taper steadily toward the end of the hook, or toward the region where the point of the hook begins.

A rectangular cross-sectional form of the hook produces a high section modulus during the knitting process. However, since the cross-sectional dimensions taper steadily toward the end of the hook, the hook can nevertheless be made with relatively small dimensions without thereby impairing its strength.

In order to favorable influence on the sliding of the thread on the knitting tool during knitting and to prevent the danger of thread breakage, the lateral limiting edges of the tool are preferably rounded off or chamfered, at least in the vicinity of the tapering portion.

Depending upon the type of strain on a given knitting tool during the knitting process, the knitting tool may be embodied such that each rectangular cross-sectional area points in the vicinity of the taper with its longer sides toward either the width dimension or the height dimension. It is also possible for at least the hook to be substantially square in cross section. In corresponding fashion, the neck as well may be substantially rectangular or square in cross section.

In a preferred embodiment, all the cross-sectional areas at least of the hook are similar to one another in the vicinity of the taper; this means that the taper is changes by identical amounts both in the direction of the width dimension and in the direction of the height dimension. The taper may also extend over the neck, which likewise has a rectangular or square cross section.

In the case where a knitting tool of this type is embodied as a latch needle, it is advantageous if the region of taper, beginning at a maximum value for the cross-sectional dimensions located in the vicinity of the highest point of the check of the needle (maximal needle cheek height), extends toward the end of the hook or toward the beginning of the hook.

Figure 2:
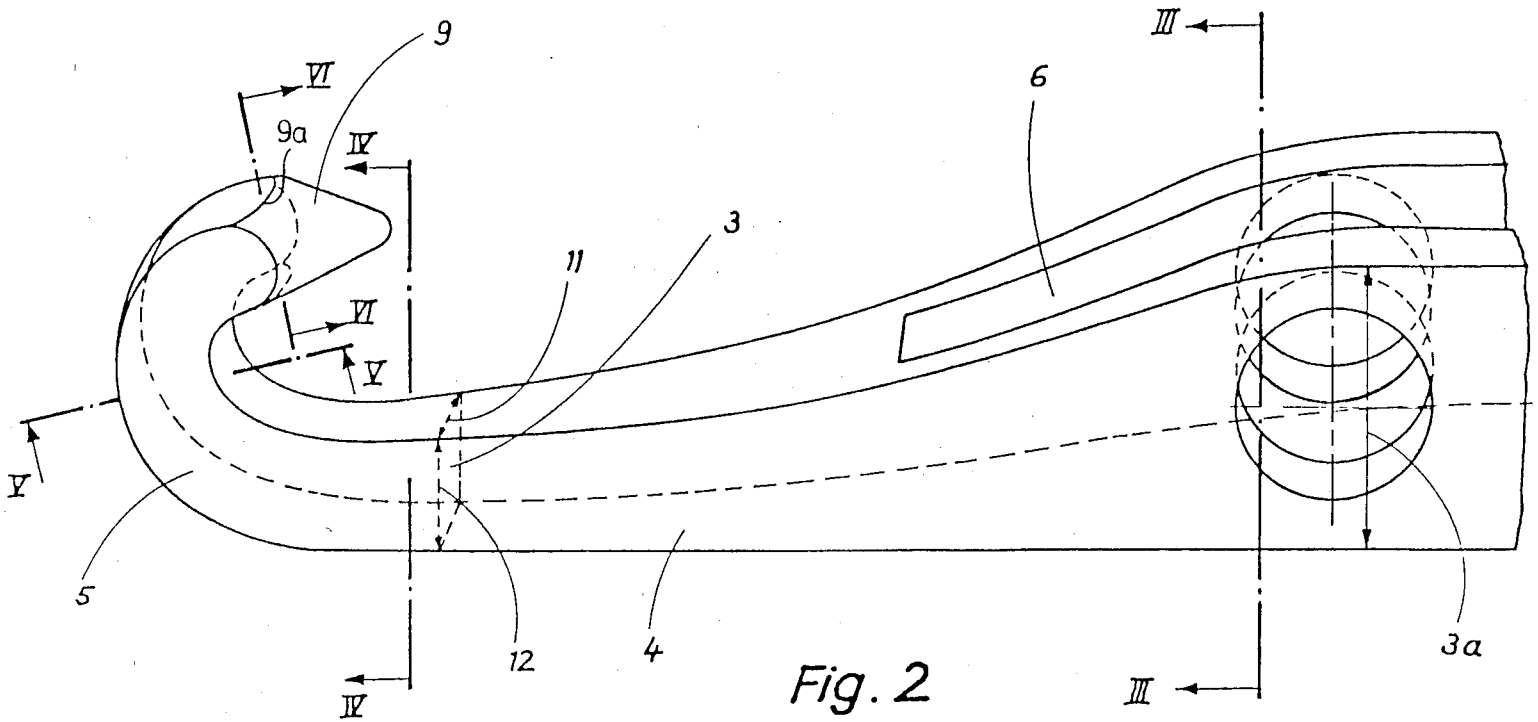
Figure 3:
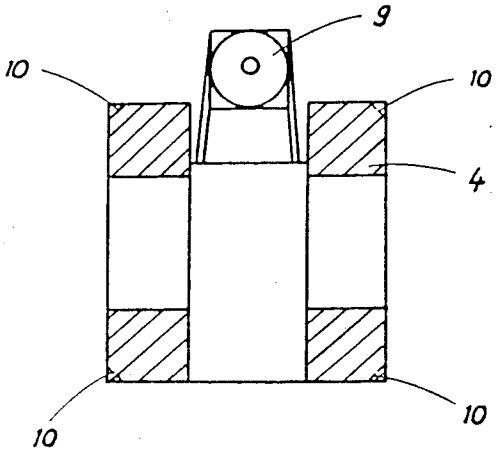
Figure 4:
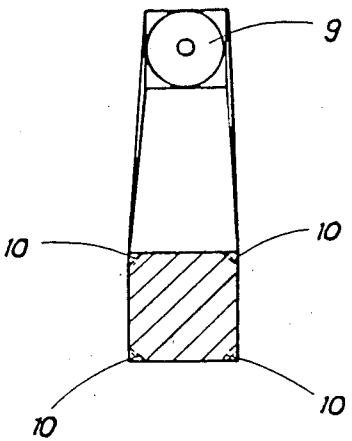
Figure 7:
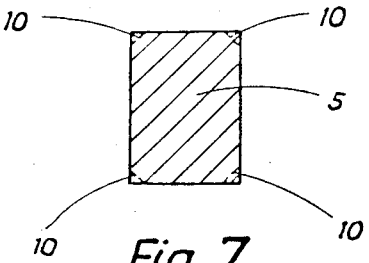
Figure 8:
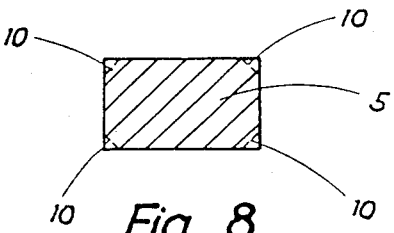

Exemplary embodiments of the subject of the invention are shown in the drawing. Shown are:

FIG. 1, a knitting tool according to the invention, embodied in the form of a latch needle, seen in a side view and shown on an enlarged scale;

FIG. 2, the knitting tool of FIG. 1, shown as a detail and in a perspective view, illustrating the hook, as well as on a different scale;

FIGS. 3–6 show the knitting tool of FIG. 2 in respective sections taken along the lines III—III, IV—IV, V—V and VI—VI of FIG. 2, seen in a side view;

FIG. 7, a cross-sectional illustration corresponding to FIG. 4 for a latch needle according to FIG. 2, in a different form of embodiment; and FIG. 8, a cross-sectional illustration corresponding to FIG. 4 for a latch needle according to FIG. 2, in a further form of embodiment.

The stamped latch needle shown in FIGS. 1–6 has a needle shank 1, which merges with the needle cheek 2 having the maximal needle cheek height indicated at 3*a*. The needle neck 4 adjoins the needle cheek 2 and is followed by the needle hook 5 which is bent into a curve. A latch slit 6 is cut out in the vicinity of the needle cheek, and a needle latch 7 is pivotably supported about a latch axle 8 is this slit 6, as may be seen in FIG. 1, which shows the latch 7 both in the closed position and—in broken lines—in the open position.

From FIG. 2 and from the cross-sectional views shown in FIGS. 3–6, it can be seen that the profiled material forming the hook 5 and the neck 4 has a substantially square cross-sectional form. The arrangement is such that, beginning at the maximum value of the cross-sectional dimension determined by the maximum needle cheek height 3*a* (FIGS. 2 and 3), the cross section of the neck 4 and the hook 5 decreases with steadily tapering cross section of dimensions up to the root 9*a* of a hook point or tip 9. The tip or point 9 of the hook has a round cross section, merging at its root 9*a* with the rectangular or square portion of hook 5. The cross sections of FIGS. 3–6 shows that all the cross-sectional areas in the tapering portion of the hook 5 and of the neck 4 are of similar shape with respect to one another.

Figure 5:
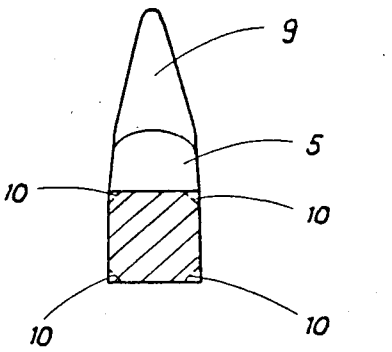
Figure 6:
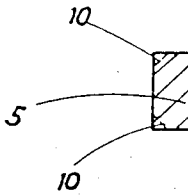

In order to provide some idea of the size relationships, it is noted that in the latch needle shown by way of example, the edge length of the square rectangular area of FIG. 4 (corresponding to the sectional plane IV—IV in FIG. 2) is 0.36 mm; the edge length of the cross-sectional area of FIG. 5 (corresponding to the sectional plane V—V of FIG. 2) is 0.31 mm; and the edge length of the cross sectional area of FIG. 6 (corresponding to the sectional line VI—VI of FIG. 2) is 0.28 mm.

The lateral limiting edges of the hook 5 and of the neck 4 may be chamfered or rounded off, as indicated at 10 by dashed lines in each of the FIGS. 3–8.

In an alternative form of embodiment, the tapering portion may also extend only along the throat and the length of the actual hook 5 itself—that is, beginning approximately the dimension lines 11, 12 in FIG. 2 that is close to the sectional plane IV—IV of FIG. 2—up to the root of the hook point 9. The region of the cheek taper of the neck 4 may have a constant thickness, which by way of example may be equal to that of the needle shank stem 1. Forms of embodiment are also conceivable in which in the vicinity of the hook the tapering is effected to an identical extent in the direction of both the width dimension 11 and the height dimension 12 perpendicular thereto, so that the cross-sectional areas are each similar squares along the length of the hook, while in the vicinity of the neck 4, beginning at the maximum needle cheek height 3*a*, the tapering is smaller in the direction of the width dimension 11 than in the direction of the height dimension 12, perpendicular thereto (see FIG. 2).

In other possible forms of embodiment, such as are indicated by different cross-sectional forms of the hook 5 in FIGS. 7 and 8, the hook 5 has a rectangular cross-sectional form—in common with the neck 4 as required. The longer sides may extend in the direction of either the width dimension 11 of the hook see FIG. 8, or with height dimension extending at right angles thereto, see FIG. 7.

We claim:

1. A stamped knitting needle for knitting machines having a shank (1) with an intermediate neck (4), a latch (7) pivotably secured in the shank, and a hook (5) located at the end of the neck, terminating in a hook tip (9), in which the hook tip only is located beneath the end of the latch when the latch is in closed position, the neck and the hook being made entirely, up to the end portion of the hook, of a shaped, stamped material of rectangular cross section, with the corners at adjacent edges of the sides of the rectangular hook being chamfered (10), wherein;

the dimensions of the rectangular cross section of the hook (5), beginning at a maximum value (3) of the cross-sectional dimensions in the vicinity of the neck (4) and in the region thereof adjacent the neck (4), are continuously decreasing, and tapering toward and up to the end of the hook and terminating at the root (9*a*) of the tip (9);

the cross-sectional areas of the continuously tapering dimensionally continuously reduced hook being all of similar shape and configuration, the hook tip (9) being rounded in the region beneath the latch, when the latch is in closed position and the root (9*a*) of the hook tip forming a transition zone from the round tip (9) to the rectangular cross section of the hook (5).

2. A knitting tool as defined in claim 1, wherein the cross-sectional area in the vicinity of the decreasing tapering dimension is rectangular with its longer sides extending in the direction of the height dimension (12) of the shank (1).

3. A knitting tool as defined in claim 2 wherein the cross sectional area of the neck (4) is substantially rectangular.

4. A knitting tool as defined in claim 3, defining, in the zone adjacent either side of the latch, a needle cheek, wherein the region of decreasing tapering cross section starts at a region of a maximum value of the cross-sectional dimension (3*a*) which is located in the vicinity of the highest point of the needle cheek and extends, in decreasing, tapering form, toward the end of the hook (5) and to the root of the hook point (9).

5. A knitting tool as defined in claim 2, defining, in the zone adjacent either side of the latch, a needle cheek, wherein the region of decreasing tapering cross section starts at a region of a maximum value of the cross-sectional dimension (3*a*) which is located in the vicinity of the highest point of the needle cheek and extends, in decreasing, tapering form, toward the end of the hook (5) and to the root of the hook point (9).

6. Knitting tool as defined in claim 2, wherein the region of the neck adjacent the hook defines a needle throat;

the continuously decreasing, tapering cross-sectional dimensions of the needle extend from the throat (4) thereof with continuously decreasing cross-sectional dimensions towards the hook (5);

and wherein the cross-sectional areas of all the continuously decreasing, tapering portions of the needle are of similar shape and configuration.

7. A knitting tool as defined in claim 1, wherein the cross sectional area of the hook (5) is substantially square.

8. A knitting tool as defined in claim 7 wherein the cross sectional area of the neck (4) is substantially square.

9. A knitting tool as defined in claim 8, defining, in the zone adjacent either side of the latch, a needle cheek, wherein the region of decreasing tapering cross section starts at a region of a maximum value of the cross-sectional dimension (3*a*) which is located in the vicinity of the highest point of the needle cheek and extends, in decreasing, tapering form, toward the end of the hook (5) and to the root of the hook point (9).

10. A knitting tool as defined in claim 7, defining, in the zone adjacent either side of the latch, a needle cheek, wherein the region of decreasing tapering cross section starts at a region of a maximum value of the cross-sectional dimension (3*a*) which is located in the vicinity of the highest point of the needle cheek and extends, in decreasing, tapering form, toward the end of the hook (5) and to the root of the hook point (9).

11. Knitting tool as defined in claim 7, wherein the region of the neck adjacent the hook defines a needle throat;

the continuously decreasing, tapering cross-sectional dimensions of the needle extend from the throat (4) thereof with continuously decreasing cross-sectional dimensions towards the hook (5);

and wherein the cross-sectional areas of all the continuously decreasing, tapering portions of the needle are of similar shape and configuration.

12. A knitting tool as defined in claim 1, defining, in the zone adjacent either side of the latch, a needle cheek, wherein the region of decreasing tapering cross section starts at a region of a maximum value of the cross-sectional dimension (*3a*) which is located in the vicinity of the highest point of the needle cheek and extends, in decreasing, tapering form, toward the end of the hook (5) and to the root of the hook tip (9).

13. Knitting tool as defined in claim 12, wherein the region of the neck adjacent the hook defines a needle throat;

the continuously decreasing, tapering cross-sectional dimensions of the needle extend from the throat (4) thereof with continuously decreasing cross-sectional dimensions towards the hook (5);

and wherein the cross-sectional areas of all the continuously decreasing, tapering portions of the needle are of similar shape and configuration.

14. Knitting tool as defined in claim 1, wherein the region of the neck adjacent the hook defines a needle throat;

the continuously decreasing, tapering cross-sectional dimensions of the needle extend from the throat (4) thereof with continuously decreasing cross-sectional dimensions towards the hook (5);

and wherein the cross-sectional areas of all the continuously decreasing, tapering portions of the needle are of similar shape and configuration.

* * * * *

UNITED STATES PATENT AND TRADEMARK OFFICE

CERTIFICATE OF CORRECTION

PATENT NO. : 4,548,056

DATED : Oct. 22, 1985

INVENTOR(S) : SCHULER et al

It is certified that error appears in the above-identified patent and that said Letters Patent is hereby corrected as shown below:

Title page:

After item (21) add:--U.S. Application filed Sept. 4, 1984--

Column 3, line 15, after "approximately" insert -- at --

Signed and Sealed this

*Twenty-fifth* Day of *February 1986*

[SEAL]

*Attest:*

DONALD J. QUIGG

*Attesting Officer*

*Commissioner of Patents and Trademarks*